United States Patent [19]

Kastening et al.

[11] 3,968,273

[45] July 6, 1976

[54] METHOD OF MAKING ELECTRODE FOR PREPARING HYDROGEN PEROXIDE

[75] Inventors: Bertel Kastening; Wolfgang Faul, both of Julich, Germany

[73] Assignee: Kernforschungsanlage Jülich Gesellschaft mit beschränkter Haftung, Julich, Germany

[22] Filed: Oct. 23, 1974

[21] Appl. No.: 517,199

[30] Foreign Application Priority Data

Oct. 24, 1973 Germany ..... 2353259

[52] U.S. Cl. ..... 427/122; 427/120; 427/295; 427/372; 204/84; 204/294; 204/265; 204/290 R

[51] Int. Cl.[2] ..... C25B 1/30; C25B 11/12

[58] Field of Search ..... 204/84, 265, 290 R, 204/294; 252/444, 421, 445; 423/460, 461; 427/122, 294, 295

[56] References Cited

UNITED STATES PATENTS

| | | | |
|---|---|---|---|
| 2,000,815 | 5/1935 | Berl | 204/84 |
| 2,093,989 | 9/1937 | Berl | 204/84 |
| 3,793,173 | 2/1974 | Kawahata | 204/84 X |
| 3,855,071 | 12/1974 | Koppelman | 201/34 X |
| 3,856,574 | 12/1974 | Amagi et al. | 204/294 X |
| 3,856,640 | 12/1974 | Halfar | 204/265 X |

*Primary Examiner*—Ralph S. Kendall
*Attorney, Agent, or Firm*—Walter Becker

[57] ABSTRACT

A method of making an electrode for preparing hydrogen peroxide, according to which active carbon during application of heat is mixed with a binder and a hydrophobic substance of addition. The thus obtained mixture is applied to an electrically conductive carrier structure. More specifically, active carbon is glowed in a vacuum at a temperature above 900°, preferably at a temperature of from 1000° to 1250°C. After the active carbon powder has been cooled in a vacuum, the active carbon powder is mixed with a solvent containing the binder and the hydrophobic substance of addition. The thus obtained mixture is applied to the electric conductive carrier substance. Finally, the mixture thus applied to the carrier structure is dried. The thus produced electrode is arranged in an electrolytic cell filled with an electrolyte. This cell comprises a gas permeable carbon cathode communicating with a gas chamber in which a pressure higher than atmospheric pressure prevails and also comprises an anode separated from the carbon cathode by a diaphragm. As carbon electrode there is used a carrier structure coated with active carbon powder which by means of a non-coated side facing away from the gas chamber rests on a metallic grate.

18 Claims, 1 Drawing Figure

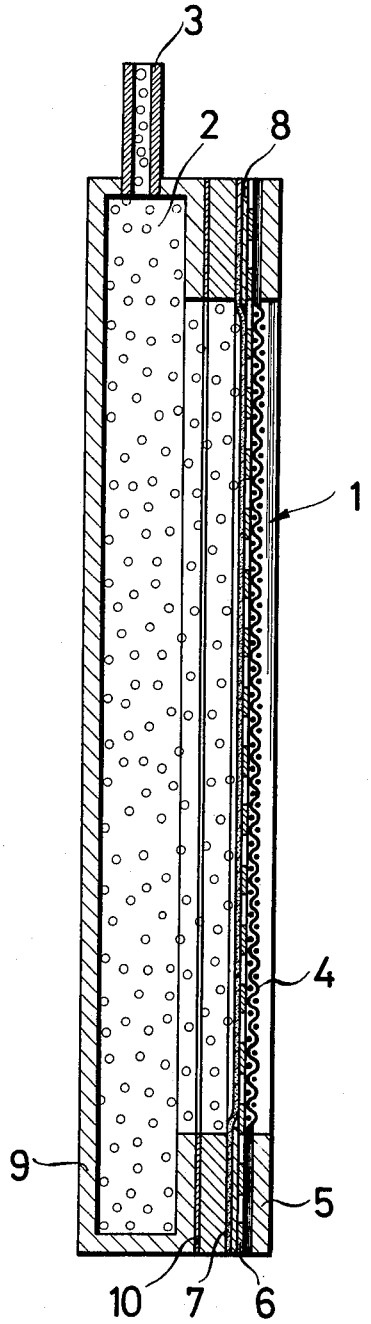
3
2
8
1
4
9
5
10
7
6

METHOD OF MAKING ELECTRODE FOR PREPARING HYDROGEN PEROXIDE

The present invention relates to a method of making an electrode suitable for the production of hydrogen peroxide, according to which under heat treatment active carbon is intermixed with a binder and a hydrophobic additional substance and in this mixture is bound to an electrically conductive carrier structure.

Various methods are known for the preparation of hydrogen peroxide. The present invention is based on a method according to which hydrogen peroxide is generated by a cathodic reduction of oxygen in an aqueous electrolyte solution. According to this method, the oxygen necessary for the reduction is under pressure introduced into the electrolyte through a gas permeable cathode charged with active carbon. For purposes of protecting the cathode from being wetted by an electrolyte solution, the electrode in addition to containing active carbon also contains a hydrophobic additional substance.

The heretofore known methods for making electrodes are aimed at mixing the active carbon with a binder and a hydrophobic additional substance, and under heat treatment to process the thus obtained mixture to a uniform electrode body. Thus, a method has been known for making a carbon-paraffin electrode according to which molten paraffin and active carbon are intermixed in hot condition and the mixture is then subjected to pressure.

It has also been suggested to produce by sintering a flexible electrode diaphragm from a homogeneous suspension of finely distributed carbon with hydrophobic additional substances after dehydration and drying, said electrode diaphragm being connected to an electric conductor in an electrolyte cell.

Electrodes consisting merely of active carbon binders and hydrophobic additional material could not yield satisfactory results in connection with the production of hydrogen peroxide. The current densities necessary for the technical application of such electrodes could not be realized. It has also become known for purposes of improving the conductivity of the electrodes to apply the mixture of active carbon, binder and hydrophobic additional material directly to an electrically conductive carrier structure. However, electrodes made in conformity with this method could not be economically employed because the activity of the carrier structures covered with active carbon decreases very quickly, and it becomes necessary in order to maintain economically feasible current yield frequently to exchange the electrodes.

It is, therefore, an object of the present invention to provide electrodes which permit commercial application on a large scale of an electrolytic manufacturing process for hydrogen peroxide while allowing a satisfactory current yield over longer periods of operation.

It is a further object of this invention to provide a method of producing electrodes which permit the relation of high current densities.

It is still another object of this invention to provide a method as set forth above which will be considerably simpler than heretofore known methods of the general type involved.

These and other objects and advantages of the invention will appear more clearly from the following specification in connection with the accompanying drawing which diagrammatically illustrates the cathode part of an electrolysis cell.

The problem underlying the present invention has been solved by the following method steps which follow each other in the sequence set forth below:

a. glowing active carbon powder in a vacuum at a temperature exceeding 900°C;

b. cooling the active carbon powder in a vacuum;

c. mixing the cooled active carbon powder with a solvent containing the binder and the hydrophobic additional substances;

d. applying the mixture to the electrically conductive carrier structure;

e. drying the mixture thus applied to the carrier structure.

Due to the glowing of the still not intermixed active carbon in a vacuum, the surface structures suitable for the production of hydrogen peroxide are freed. After the active carbon powder has been cooled in a vacuum, there is obtained an active carbon powder having properties which are highly suitable for the method of making hydrogen peroxide. The active carbon powder is mixed with binders and hydrophobic additional material. The mixing may be effected with the method according to the invention, advantageously at room temperature, a heat treatment in particular a sintering of the mixture itself is obviated. The preparation of the mixture is effected with a solvent which greatly facilitates the application of the mixture to the carrier structure.

After the drying process, a sufficiently fine active carbon layer remains on the carrier structure. This fine active carbon layer will surprisingly, over a long period of operation, retain sufficient activity so that without frequent exchange of the electrode during the manufacture of hydrogen peroxide, high current yield can be realized.

It has proved advantageous to glow the active carbon powder at least over a time period of 30 minutes. Such a glowing period will suffice to eliminate most of the unsuitable surface structures in the active carbon powder. Advantageously, a treatment in a vacuum of from 0.1 to 10 Torr has favorable effects. As optimum temperature range, a glowing within the temperature range of from 1,000° to 1,250°C has proved very satisfactory. Preferably in both instances a glowing period of from 2 to 4 hours is maintained. Under these conditions of operation, the current densities as well as the periods of operation of the electrodes can be materially improved without reducing the activity.

For as uniformly as possible distributing and homogeneously mixing active carbon powder with a binder and hydrophobic additional substances it is advantageous to sift or screen the active carbon powder as it has cooled and to prepare the mixture with active carbon particles having a granular size of up to 80 $\mu$m. On the carrier structure there will then occur a highly porous layer. The application of the mixture to the carrier structure will be facilitated when during the preparation of the mixture, each 100 ml of a solvent are intermixed with from 2 to 10 grams of active carbon powder, 0.2 to 1 gram of rubber material or caoutchouc and with from 0.1 to 1 gram paraffin. In this dilution, a sufficiently fine active carbon layer forms on the surface of the carrier structure. The gas pressure which is necessary to penetrate the layer can be kept extremely low.

According to a further development of the invention, it is provided to employ as carrier structure a metal wire network with meshes between 0.05 and 0.3 mm. On such carrier structure, not only a good adherence of the layer is obtained but also a uniform smooth surface is secured. The electrodes are, especially at their areas to be clamped-in, exposed to strong mechanical stresses and, therefore, are easily destroyed within their marginal zones. In order to protect the electrodes, the metal wire network is according to a further development of the invention, prior to the application of the mixture intermixed with solvents covered with a protective layer within the region of the marginal zones. It is advantageous when the protective layer contains hydrophobic components which are also employed when preparing the mixture. The adhering ability of the active carbon layer to the rim is improved in this way. Preferably, the protective layer is applied in the form of a solvent of from 1 to 3 grams of rubber material or caoutchouc in 100 ml of solvent.

For purposes of aiding the electrolyte repelling effect of the hydrophobic additional substance, it is suggested according to a further development of the invention, to treat the covered surface of the carrier structure after the drying, with a spray containing polytetrafluoroethylene. A particular advantage of the method according to the present invention consists in that electrodes prepared according to the method of the invention can very simply be regenerated. It will suffice to treat the electrodes for a short period with a diluted acid and subsequently to rinse the same in order to make them again completely applicable. The carrier structures can without further difficulties again be covered or coated while applying the method according to the invention. The electrodes made according to the present invention are advantageously employed in an electrolysis cell filled with electrolyte which cell has a gas permeable carbon cathode connected to a gas chamber with an overpressure therein, and also comprises an anode separated from the carbon cathode by a diaphragm. According to the invention it is provided that as carbon cathode there is employed a carrier structure which is unilaterally coated with an active carbon powder, said carrier structure resting until its non-coated side facing away from the gas chamber, against a metallic grate. Advantageously, this step brings about an intimate contact between the metallic grate and the non-coated side of the carrier structure so that also with large surface electrodes always a uniform current supply over the entire electrode surface will be assured. Preferably, for purposes of preventing a mechanical destruction of the electrode in the electrolysis cell, an electrode is employed, the carrier structure of which is within the region of the marginal zones covered by a protective layer and which in said range is connected in a gas-tight manner to said gas chamber.

The method according to the invention will now be explained in detail in connection with the following example:

50 grams of active carbon powder having a granular size of from 10 to 150 $\mu$m are glowed for 2 hours at 1100°C in a quartz vessel which has been evacuated up to a pressure of 1 Torr. The carbon which is aerated in a vacuum after it has cooled off is screened and is in three granular sizes of from 80 to 56 $\mu$m, from 56 to 40 $\mu$m and from 40 to 20 $\mu$m mixed at the weight ratio of from 2:3:5.

For purposes of preparing active carbon powder with a binding substance and hydrophobic additional material in a solvent, first 10 grams of rubber material are dissolved in 200 Toluol and 200 ml Xylol. Subsequently, 20 ml of this solution are mixed with 200 mg of paraffin and the thus obtained mixture is diluted with 300 ml of Toluol and 30 ml Xylol. To each 20 ml of this paraffin containing solution are added 1 gram of the activated active carbon mixture and are worked into a brushable paste. As carrier structure there is employed a circular high quality steel net which has a wire thickness of 0.1 mm and a mesh width of 0.16 mm. The high grade steel net has applied to one side of one surface of 50 cm$^2$ such an application of active carbon paste that after the drying of the high grade steel net, on the high grade steel net there will remain a mixture of active carbon powder with a solvent and a hydrophobic addition with a layer thickness corresponding to 10 mg active carbon cm$^2$.

The thus produced electrode is employed as cathode in an electrolysis cell for producing hydrogen peroxide. For purposes of cathodic reduction of oxygen, air is blown through the cathode.

In the electrolysis cell, a nickel wire net serves as anode. The electrolysis cell comprises a diaphragm of synthetic material which is connected between the anode and the cathode and by means of which the electrolysis cell is divided into an anode chamber and a cathode chamber. An electrolyte there is employed 4-normal potash lye. The potash lye passes through the electrolysis cell at a speed of 250 ml per hour. The potash lye is first passed into the anode chamber from where it passes into the cathode chamber and is subsequently conveyed to a separating device for obtaining the hydrogen peroxide. The cleaned potash lye flows back into the anode chamber.

Charging a cathode made according to the method of the present invention with a current density of 5A/dm$^2$ yielded over a time of operation of 370 hours a current yield of 93.5%. During the operation, the cell voltage amounted to 3.4V while the temperature of the electrolyte was 10°C. An increase in the current density to 10A/dm$^2$ at a cell voltage of 6.4V and an electrolyte temperature of 14°C brought about a current yield of 81.5%. At current densities of 15A/dm$^2$ a cell voltage of 9.5V and an electrolyte temperature of 18°C, still relatively high current yields of 64.7% could be obtained.

The current yields can still be considerably increased when the cathode coated with active carbon is blown through by pure oxygen instead of by air.

There will now be explained the advantageous employment of an electrode made according to the invention.

The cathode 1 of the electrolysis cell communicates with a gas chamber 2 which through a passage 3 is supplied with oxygen or with a gas containing oxygen. The cathode 1 consists of a nickel frame 5 covered by a nickel net 4. A carrier structure 6 which in conformity with the method of the invention is covered with a mixture of active carbon with a binder and a hydrophobic additional substance is connected to said nickel frame 5. The carrier structure 6 is advantageously only on one side of the side facing the gas chamber 2 covered by an active carbon layer 7 and rests with its free side against the nickel net 4. For purposes of protecting the marginal zones, the carrier frame 6 is provided with a cover layer 8. Between the carrier structure 6 and the wall 9 of the gas chamber 2 there is arranged a seal 10 which after the nickel frame 5 has been rigged to the wall 9 of the gas chamber 2 brings about a gastight closure.

During the operation of the electrolysis cell, 100 liters of oxygen were passed per hour through the cathode surface which in the specific example set forth has a size of $0.4m^2$. In the gas chamber there prevailed an overpressure of approximately 35 Torr. This overpressure is sufficient in order to effect an intimate contact between the carrier structure 6 and the nickel net 2 and thus to create the prerequisites for a proper current distribution over the cathode surfaces.

After a continuous operation of 100 hours (operation with 4-normal potash lye, cathode chamber temperature of 18°C, current density of $10A/dm^2$; current yield of 75%), the cathode was removed, treated with diluted hydrochloric acid and subsequently rinsed for a few hours in distilled water. Without any further post treatment, the electrode showed when again employed no signs that its advantageous properties were affected.

It is, of course, to be understood, that the present invention is, by no means, limited to the specific example and illustration in the drawing, but also comprises any modifications within the scope of the appended claims.

What we claim is:

1. A method of making an electrode for preparing hydrogen peroxide, which includes the steps of: glowing active carbon powder in a vacuum at a temperature above 900°C, cooling the thus treated active carbon powder in a vacuum, mixing the thus cooled active carbon powder with a solvent containing a binder and a hydrophobic additional substance, applying the thus obtained mixture onto an electrically conductive carrier structure, drying said mixture applied onto said carrier structure, and glowing said active carbon powder for a period of at least 30 minutes.

2. A method according to claim 1, in which said vacuum amounts to from 0.1 to 10 Torr.

3. A method according to claim 1, in which said active carbon powder is glowed within a temperature range of from 1000°C to 1250°C.

4. A method according to claim 1, which includes the steps of screening the cooled active carbon powder and preparing said binder and hydrophobic additional substance mixture with active carbon particles having a granular size up to 80 $\mu$m.

5. A method according to claim 1, which includes the step of adding to said mixture per each 100 ml solvent from 2 to 10 grams of active carbon powder, from 0.2 to 1 gram of caoutchouc material, and from 0.1 to 1 gram of paraffin.

6. A method according to claim 1, which includes the step of employing as carrier structure a metal wire net having meshes of from 0.05 to 0.3 millimeters.

7. A method according to claim 6, which includes applying to the marginal zones of said metal wire net preliminarily a protective layer prior to applying thereto said binder and hydrophobic additional substance mixture containing the solvents.

8. A method according to claim 7, in which said protective layer includes hydrophobic components.

9. A method according to claim 8, in which the protective layer is applied in the form of a solution containing from 1 to 3 grams caoutchouc material per 100 ml solvent.

10. A method according to claim 7, in which the hydrophobic components are the same that are added when preparing said mixture.

11. A method according to claim 1, which includes the step of treating the covered surface of the carrier structure following the drying of said carrier structure with a spray substance containing polytetrafluoroethylene.

12. A method of making an electrode for preparing hydrogen peroxide, which includes the steps of: glowing active carbon powder in a vacuum at a temperature above 900° C, cooling the thus treated active carbon powder in a vacuum, mixing the thus cooled active carbon powder with a solvent containing a binder and a hydrophobic additional substance, applying the thus obtained mixture onto an electrically conductive carrier structure, and drying said mixture applied onto said carrier structure, the glowing of said active carbon powder being effected for a time period of from 2 to four hours.

13. A method according to claim 12, in which said vacuum amounts to from 0.1 to 10 Torr.

14. A method according to claim 12, in which said active carbon powder is glowed within a temperature range of from 1000°C to 1250°C.

15. A method according to claim 12, which includes the steps of screening the cooled active carbon powder and preparing said binder and hydrophobic additional substance mixture with active carbon particles having a granular size up to 80 $\mu$m.

16. A method according to claim 12, which includes the step of adding to said mixture per each 100 ml solvent from 2 to 10 grams of active carbon powder, from 0.2 to 1 gram of caoutchouc material, and from 0.1 to 1 gram of paraffin.

17. A method according to claim 12, which includes the step of employing as carrier structure a metal wire net having meshes of from 0.05 to 0.3 millimeters.

18. A method according to claim 12, which includes the step of treating the covered surface of the carrier structure following the drying of said carrier structure with a spray substance containing polytetrafluoroethylene.

* * * * *